US006490989B1

(12) United States Patent
Ray

(10) Patent No.: US 6,490,989 B1
(45) Date of Patent: Dec. 10, 2002

(54) PROPELLING SYSTEM

(76) Inventor: James R. Ray, 6882 Audubon Ave., Niwot, CO (US) 80503

( * ) Notice: Subject to any disclaimer, the term of this patent is extended or adjusted under 35 U.S.C. 154(b) by 0 days.

(21) Appl. No.: 10/080,637

(22) Filed: Feb. 22, 2002

(51) Int. Cl.[7] ..... B63B 7/04
(52) U.S. Cl. ..... 114/352; 114/345
(58) Field of Search ..... 114/345, 346, 114/343, 364, 352–354; 440/6, 129–132

(56) References Cited

U.S. PATENT DOCUMENTS 2,529,961 A * 11/1950 Phillips
2,958,876 A * 11/1960 Garrett
3,324,488 A * 6/1967 Schulz
4,825,790 A * 5/1989 Strout ..... 114/39.1
4,911,094 A * 3/1990 Akers
D307,171 S * 4/1990 Engle ..... D22/147
4,938,722 A * 7/1990 Rizley
5,090,930 A * 2/1992 Walden
5,474,481 A * 12/1995 Ramsey
5,485,981 A * 1/1996 Lindahl
D384,636 S * 10/1997 Beck et al.
5,692,450 A * 12/1997 Alter et al. ..... 114/61
5,878,688 A * 3/1999 Merret et al. ..... 114/354
6,142,839 A * 11/2000 Wilcox ..... 440/6

* cited by examiner

*Primary Examiner*—Ed Swinehart

(57) ABSTRACT

A propelling system for propelling a fisherman's float through the water while fishing. The propelling system includes a frame assembly having a plurality of strap members. Each of the strap members is designed for selectively engaging the floatation device whereby the strap members are for securing the frame assembly to the floatation device. A propelling assembly is coupled to the frame assembly. The propelling assembly designed for propelling the flotation device along the top of the water when a fisherman is positioned in the floatation device. At least one rod member is coupled to the frame member. The rod member is designed for holding a fishing rod. The rod member is designed for being positioned proximate the fisherman whereby the rod member facilitates access to the fishing rod by the fisherman when the fisherman is positioned in the floatation device.

20 Claims, 4 Drawing Sheets

PROPELLING SYSTEM

BACKGROUND OF THE INVENTION

1. Field of the Invention

The present invention relates to fisherman's float propelling systems and more particularly pertains to a new propelling system for propelling a fisherman's float through the water while fishing.

2. Description of the Prior Art

The use of fisherman's float propelling systems is known in the prior art. U.S. Pat. No. 4,938,722 describes a system for propelling a fisherman in a float through the water while the fisherman is floating. Another type of fisherman's float propelling systems is U.S. Pat. No. 5,485,981 having an assembly for supporting an outboard motor on float tube to propel the float tube through the water. U.S. Pat. No. 3,324,488 has a motor coupled to an aquatic floater for propelling the aquatic floater through the water. U.S. Pat. No. 4,911,094 has a power unit floater coupled to a float tube for propelling the float tube through the water. U.S. Pat. No. 5,474,481 has a floatation system for supporting a user in a body of water. U.S. Pat. No. Des 384,636 shows a float power mount. U.S. Pat. No. 2,529,961 has a float for supporting a user in water.

While these devices fulfill their respective, particular objectives and requirements, the need remains for a system that has certain improved features that is easily transported over the land.

SUMMARY OF THE INVENTION

The present invention meets the needs presented above by providing a plurality of wheel members coupled to the housing of the frame assembly that are used to facilitated transportation across the ground.

Still yet another object of the present invention is to provide a new propelling system that facilitates transportation across the ground when traversing between preferred fishing spots.

Even still another object of the present invention is to provide a new propelling system that facilitates movement of the float device through the water.

To this end, the present invention generally comprises a frame assembly having a plurality of strap members. Each of the strap members is designed for selectively engaging the floatation device whereby the strap members are for securing the frame assembly to the floatation device. A propelling assembly is coupled to the frame assembly. The propelling assembly designed for propelling the flotation device along the top of the water when a fisherman is positioned in the floatation device. At least one rod member is coupled to the frame member. The rod member is designed for holding a fishing rod. The rod member is designed for being positioned proximate the fisherman whereby the rod member facilitates access to the fishing rod by the fisherman when the fisherman is positioned in the floatation device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
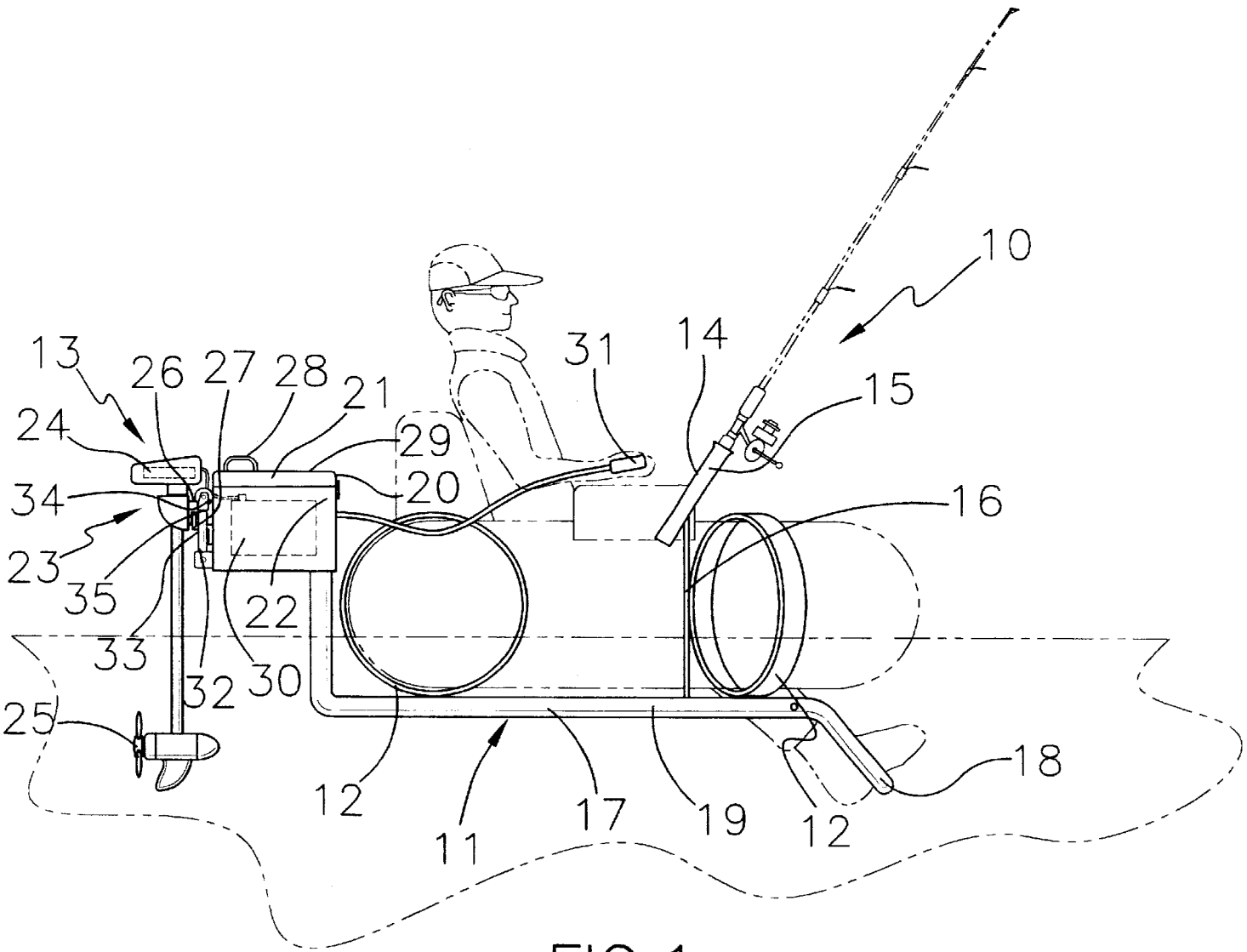
FIG. 1 is a side view of a new propelling system according to the present invention shown in use.
Figure 2:
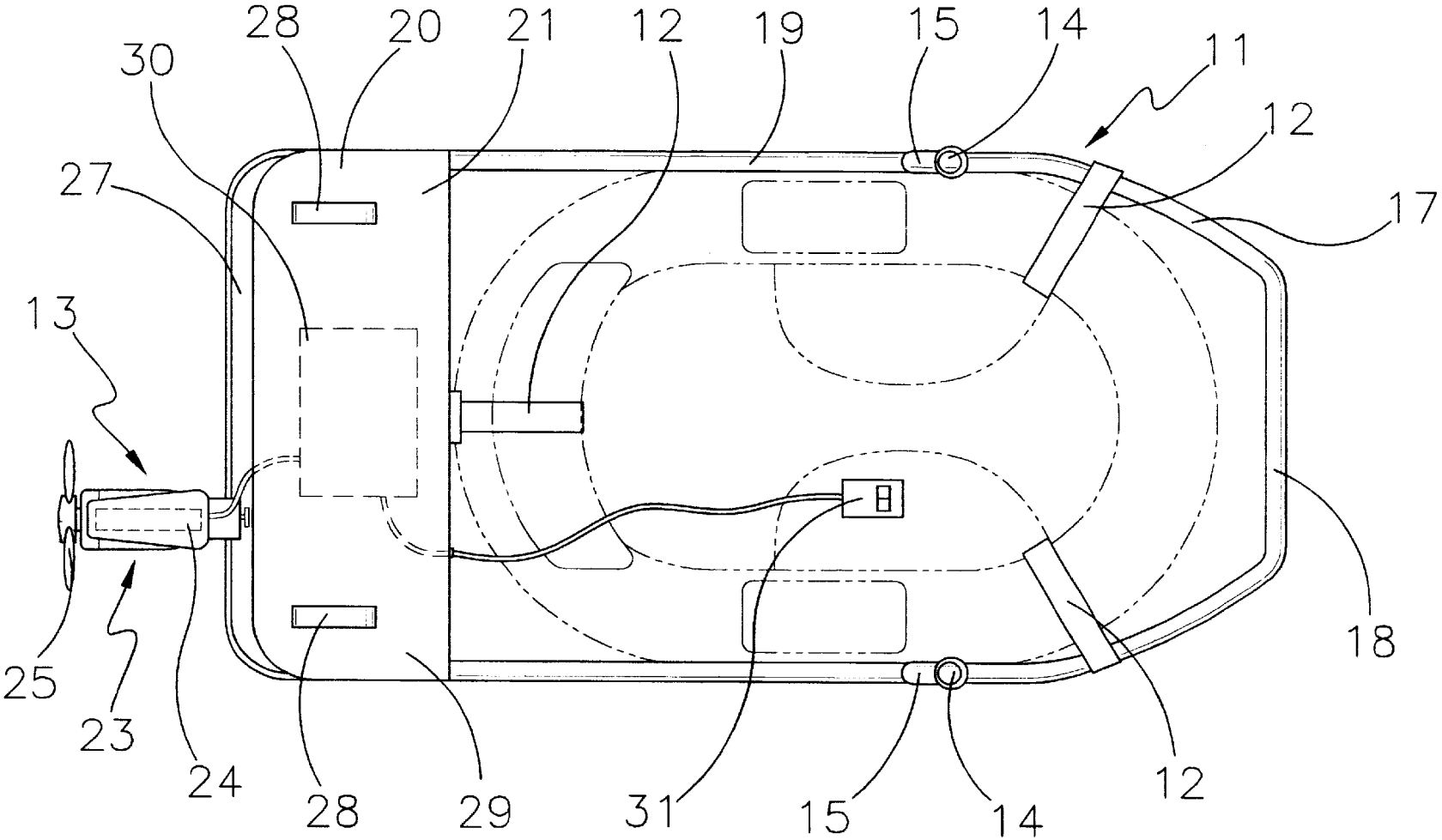
FIG. 2 is a top view of the present invention.
Figure 3:
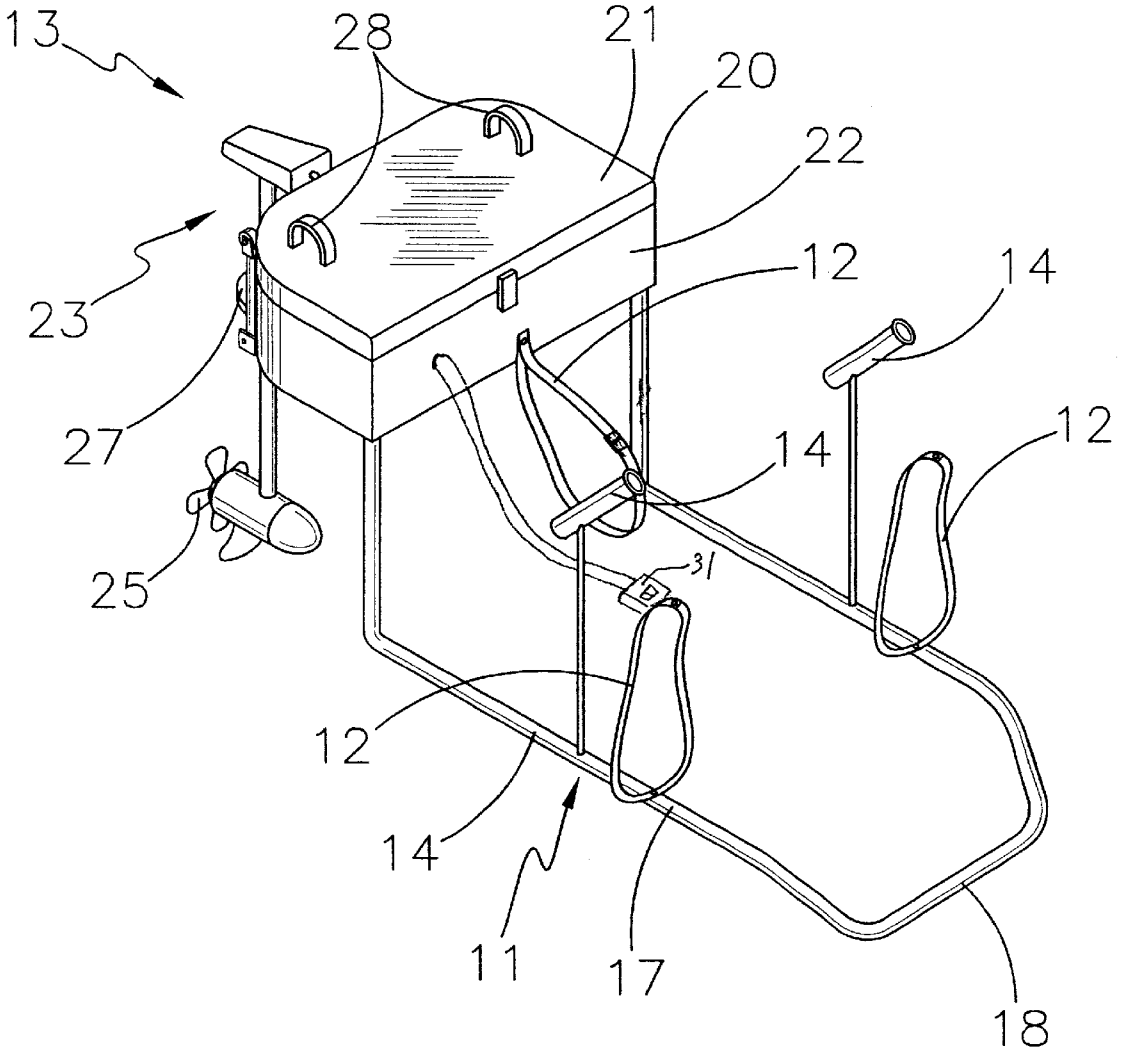
FIG. 3 is a perspective view of the present invention.
Figure 4:
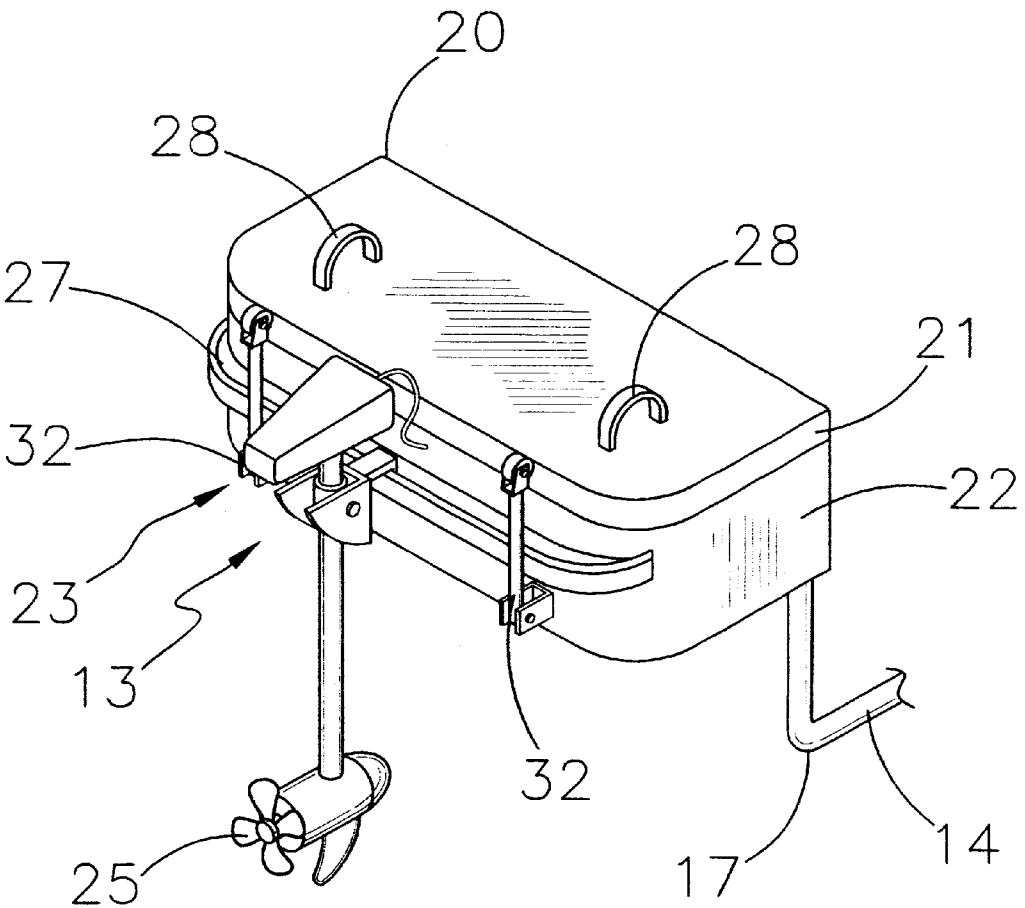
FIG. 4 is a perspective view of the rear of the present invention.

With reference now to the drawings, and in particular to FIGS. 1 through 4 thereof, a new propelling system embodying the principles and concepts of the present invention and generally designated by the reference numeral 10 will be described.

As best illustrated in FIGS. 1 through 4, the propelling system 10 generally comprises a frame assembly 11 having a plurality of strap members 12. Each of the strap members 12 is designed for selectively engaging the floatation device whereby the strap members 12 are for securing the frame assembly 11 to the floatation device.

A propelling assembly 13 is coupled to the frame assembly 11. The propelling assembly 13 designed for propelling the flotation device along the top of the water when a fisherman is positioned in the floatation device.

At least one rod member 14 is coupled to the frame member 17. The rod member 14 is designed for holding a fishing rod. The rod member 14 is designed for being positioned proximate the fisherman whereby the rod member 14 facilitates access to the fishing rod by the fisherman when the fisherman is positioned in the floatation device.

The rod member 14 has a sleeve portion 15. The sleeve portion 15 is designed for receiving a handle of the fishing pole whereby the sleeve portion 15 is designed for securing the fishing pole to the frame assembly 11. The rod member 14 has a stanchion portion 16. The stanchion portion 16 downwardly extends from the sleeve portion 15 of the rod member 14. The stanchion portion 16 is designed for rotatably coupling to the frame assembly 11 for permitting the fishing pole to be rotated with respect to the frame assembly 11 for repositioning of a tip of the fishing pole by the fisherman.

The frame assembly 11 has a frame member 17. The frame member 17 is designed for extending around the floatation device whereby the floatation device is positioned above the frame member 17 of the frame assembly 11. The strap members 12 are coupled to the frame member 17 whereby the strap members 12 are for securing the floatation device on top of the frame member 17 of the frame assembly 11.

The frame member 17 of the frame assembly 11 has a foot portion 18. The foot portion 18 is positioned opposite the propelling assembly 13 whereby the foot portion 18 downwardly extends from a main portion 19 of the frame member 17. The foot portion 18 of the frame member 17 is designed for supporting feet of the fisherman when the fisherman is positioned in the floatation device.

The frame assembly 11 has a housing 20. The propelling assembly 13 is coupled to the housing 20 of the frame assembly 11. The housing 20 has a lid portion 21. The lid portion 21 is hingably coupled to a body portion 22 of the housing 20. The lid portion 21 is designed for controlling access to the inside of the body portion 22 of the housing 20. The housing 20 can be filled with foam to provide further bouyancy to the floatation device.

The propelling assembly 13 comprises a motor assembly 23. The motor assembly 23 is coupled to the housing 20 of the frame assembly 11. The motor assembly 23 is designed for engaging the water whereby the motor assembly 23 is designed for facilitating movement through the water. The motor assembly 23 has a motor 24. The motor 24 is operationally coupled to a propeller 25. The motor 24 is for rotating the propeller 25 in the water whereby the propeller 25 is designed for displacing water for propelling the frame assembly 11 and floatation device through the water. The motor assembly 23 has a mounting portion 26. The mounting portion 26 selectively engages a lip 27 of the housing 20 of the frame assembly 11. The mounting portion 26 is for securing the motor assembly 23 to the frame assembly 11.

The housing 20 of the frame assembly 1I has a plurality of securing straps 28. The securing straps 28 are positioned on a top surface 29 of the lid portion 21 of the housing 20. The securing straps 28 selectively receive the motor assembly 23 for storing the motor assembly 23 when the floatation device is not in the water.

The propelling assembly 13 has a battery 30. The battery 30 is positioned within the body portion 22 of the housing 20. The battery 30 is operationally coupled to the motor assembly 23 hereby the battery 30 is for providing power to the motor assembly 23. The housing 20 is designed for preventing the water from contacting the battery 30.

The propelling assembly 13 has a remote control 31. The remote control 31 is operationally coupled to the motor assembly 23. The remote control 31 is designed for being engaged by the fisherman whereby the remoter control is for controlling the motor assembly 23.

The frame assembly 11 has a plurality of wheel 34 members 32. Each of the wheel 34 members 32 is pivotally coupled to the housing 20 of the frame assembly 11 whereby each of the wheel 34 members 32 are selectively pivoted between a stored position and a deployed position. The deployed position is defined by each of the wheel 34 members 32 extending downwardly from the housing 20 whereby each of the wheel 34 members 32 is designed for engaging the ground for facilitating transportation of the frame assembly 11 and the flotation device across land. The stored position is defined by each of the wheel 34 members 32 is positioned adjacent a rear wall of the housing 20 when the floatation device is positioned in the water, and Each of the wheel 34 members 32 has a support portion 33 and a wheel 34. The support portion 33 is coupled to the housing 20 of the frame assembly 11. The wheel 34 is rotatably coupled to a free end 35 of the support portion 33 whereby the wheel 34 is designed for rolling across the ground when the associated one of the wheel 34 members 32 is in the deployed position.

In use, the fisherman rotates each of the wheel 34 members 32 so that the wheel 34 engages the ground. The fisherman can then pull on the foot portion 18 of the frame member 17 to transport the frame assembly 11 and the floatation device to the water. The wheel 34 members 32 are pivoted to the stored position when the floatation device is positioned in the water. The motor assembly 23 is removed from the securing straps 28 and mounted to the housing 20 of the frame assembly 11 so that the propeller 25 is positioned in the water. The fisherman then positions themselves in the floatation device and places their feet on the foot portion 18 of the frame member 17. The fisherman then uses the remote control 31 to control the motor assembly 23 for controlling their movement through the water.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A propelling system for propelling a fisherman flotation device, the propelling system:

a frame assembly having a plurality of strap members, each of said strap members being adapted for selectively engaging the floatation device such that said strap members are for securing said frame assembly to the floatation device;

a propelling assembly being coupled to said frame assembly, said propelling assembly adapted for propelling the flotation device along the top of the water when a fisherman is positioned in the floatation device;

at least one rod member being coupled to said frame member, said rod member being adapted for holding a fishing rod, said rod member being adapted for being positioned proximate the fisherman such that said rod member facilitates access to the fishing rod by the fisherman when the fisherman is positioned in the floatation device;

said frame assembly having a frame member, said frame member being adapted for extending around the floatation device such that the floatation device is positioned above said frame member of said frame assembly, said strap members being coupled to said frame member such that said strap members are for securing the floatation device on top of said frame member of said frame assembly; and said frame member of said frame assembly having a foot portion, said foot portion being positioned opposite said propelling assembly such that said foot portion downwardly extends from a main portion of said frame member, said foot portion of said frame member being adapted for supporting feet of the fisherman when the fisherman is positioned in the floatation device.

2. The propelling system as set forth in claim 1, further comprising:

said rod member having a sleeve portion, said sleeve portion being adapted for receiving a handle of the fishing pole such that said sleeve portion is adapted for securing the fishing pole to said frame assembly.

3. The propelling system as set forth in claim 2, further comprising:

said rod member having a stanchion portion, said stanchion portion downwardly extending from said sleeve portion of said rod member, said stanchion portion being adapted for rotatably coupling to said frame assembly for permitting the fishing pole to being rotated with respect to said frame assembly for repositioning of a tip of the fishing pole by the fisherman.

4. The propelling system as set forth in claim 1, further comprising:

said frame assembly having a housing, said propelling assembly being coupled to said housing of said frame assembly, said housing having a lid portion, said lid portion being hingably coupled to a body portion of said housing, said lid portion being adapted for controlling access to the inside of said body portion of said housing.

5. The propelling system as set forth in claim 4, further comprising:

said propelling assembly comprising a motor assembly, said motor assembly being coupled to said housing of said frame assembly, said motor assembly being adapted for engaging the water such that said motor assembly is adapted for facilitating movement through the water.

6. The propelling system as set forth in claim 5, further comprising:

said motor assembly having a motor, said motor being operationally coupled to a propeller, said motor being for rotating said propeller in the water such that said propeller is adapted for displacing water for propelling the frame assembly and floatation device through the water.

7. The propelling system as set forth in claim 5, further comprising:

said motor assembly having a mounting portion, said mounting portion selectively engaging a lip of said housing of said housing of said frame assembly, said mounting portion being for securing said motor assembly to said frame assembly.

8. The propelling system as set forth in claim 5, further comprising:

said housing of said frame assembly having a plurality of securing straps, said securing straps are positioned on a top surface of said lid portion of said housing, said securing straps selectively receiving said motor assembly for storing said motor assembly when the floatation device is not in the water.

9. The propelling system as set forth in claim 5, further comprising:

said propelling assembly having a battery, said battery being positioned within said body portion of said housing, said battery being operationally coupled to said motor assembly such that said battery is for providing power to said motor assembly, said housing being adapted for preventing the water from contacting said battery.

10. The propelling system as set forth in claim 5, further comprising:

said propelling assembly having a remote control, said remote control being operationally coupled to said motor assembly, said remote control being adapted for being engaged by the fisherman such that said remoter control is for controlling said motor assembly.

11. The propelling system as set forth in claim 4, further comprising:

said frame assembly having a plurality of wheel members, each of said wheel members being pivotally coupled to said housing of said frame assembly such that each of said wheel members are selectively pivoted between a stored position and a deployed position, said deployed position being defined by each of said wheel members extending downwardly from said housing such that each of said wheel members is adapted for engaging the ground for facilitating transportation of said frame assembly and the flotation device across land, said stored position being defined by each of said wheel members being positioned adjacent a rear wall of said housing when the floatation device is positioned in the water.

12. The propelling system as set forth in claim 11, further comprising:

each of said wheel members having a support portion and a wheel, said support portion being coupled to said housing of said frame assembly, said wheel being rotatably coupled to a free end of said support portion such that said wheel is adapted for rolling across the ground when the associated one of said wheel members is in said deployed position.

13. The propelling system as set forth in claim 1, further comprising:

said rod member having a sleeve portion, said sleeve portion being adapted for receiving a handle of the fishing pole such that said sleeve portion is adapted for securing the fishing pole to said frame assembly;

said rod member having a stanchion portion, said stanchion portion downwardly extending from said sleeve portion of said rod member, said stanchion portion being adapted for rotatably coupling to said frame assembly for permitting the fishing pole to being rotated with respect to said frame assembly for repositioning of a tip of the fishing pole by the fisherman;

said frame assembly having a housing, said propelling assembly being coupled to said housing of said frame assembly, said housing having a lid portion, said lid portion being hingably coupled to a body portion of said housing, said lid portion being adapted for controlling access to the inside of said body portion of said housing;

said propelling assembly comprising a motor assembly, said motor assembly being coupled to said housing of said frame assembly, said motor assembly being adapted for engaging the water such that said motor assembly is adapted for facilitating movement through the water;

said motor assembly having a motor, said motor being operationally coupled to a propeller, said motor being for rotating said propeller in the water such that said propeller is adapted for displacing water for propelling the frame assembly and floatation device through the water;

said motor assembly having a mounting portion, said mounting portion selectively engaging a lip of said housing of said housing of said frame assembly, said mounting portion being for securing said motor assembly to said frame assembly;

said housing of said frame assembly having a plurality of securing straps, said securing straps are positioned on a top surface of said lid portion of said housing, said securing straps selectively receiving said motor assembly for storing said motor assembly when the floatation device is not in the water;

said propelling assembly having a battery, said battery being positioned within said body portion of said housing, said battery being operationally coupled to said motor assembly such that said battery is for providing power to said motor assembly, said housing being adapted for preventing the water from contacting said battery;

said propelling assembly having a remote control, said remote control being operationally coupled to said motor assembly, said remote control being adapted for being engaged by the fisherman such that said remoter control is for controlling said motor assembly;

said frame assembly having a plurality of wheel members, each of said wheel members being pivotally coupled to said housing of said frame assembly such that each of said wheel members are selectively pivoted between a stored position and a deployed position, said deployed position being defined by each of said wheel members extending downwardly from said housing such that each of said wheel members is adapted for engaging the ground for facilitating transportation of said frame assembly and the flotation device across land, said stored position being defined by each of said wheel members being positioned adjacent a rear wall of said housing when the floatation device is positioned in the water; and each of said wheel members having a support portion and a wheel, said support portion being coupled to said housing of said frame assembly, said wheel being rotatably coupled to a free end of said support portion such that said wheel is adapted for rolling across the ground when the associated one of said wheel members is in said deployed position.

14. A propelling system for propelling a fisherman flotation device, the propelling system:

a frame assembly having a plurality of strap members, each of said strap members being adapted for selectively engaging the floatation device such that said strap members are for securing said frame assembly to the floatation device;

a propelling assembly being coupled to said frame assembly said propelling assembly adapted for propelling the flotation device along the top of the water when a fisherman is positioned in the floatation device;

at least one rod member being coupled to said frame member, said rod member being adapted for holding a fishing rod, said rod member being adapted for being positioned proximate the fisherman such that said rod member facilitates access to the fishing rod by the fisherman when the fisherman is positioned in the floatation device;

said frame assembly having a housing, said propelling assembly being coupled to said housing of said frame assembly, said housing having a lid portion, said lid portion being hingably coupled to a body portion of said housing, said lid portion being adapted for controlling access to the inside of said body portion of said housing;

said propelling assembly comprising a motor assembly, said motor assembly being coupled to said housing of said frame assembly, said motor assembly being adapted for engaging the water such that said motor assembly is adapted for facilitating movement through the water; and said housing of said frame assembly having a plurality of securing straps, said securing straps are positioned on a top surface of said lid portion of said housing, said securing straps selectively receiving said motor assembly for storing said motor assembly when the floatation device is not in the water.

15. The propelling system as set forth in claim 14, further comprising:

said motor assembly having a motor, said motor being operationally coupled to a propeller, said motor being for rotating said propeller in the water such that said propeller is adapted for displacing water for propelling the frame assembly and floatation device through the water.

16. The propelling system as set forth in claim 14, further comprising:

said motor assembly having a mounting portion, said mounting portion selectively engaging a lip of said housing of said housing of said frame assembly, said mounting portion being for securing said motor assembly to said frame assembly.

17. The propelling system as set forth in claim 14, further comprising:

said propelling assembly having a battery, said battery being positioned within said body portion of said housing, said battery being operationally coupled to said motor assembly such that said battery is for providing power to said motor assembly, said housing being adapted for preventing the water from contacting said battery.

18. The propelling system as set forth in claim 14, further comprising:

said propelling assembly having a remote control, said remote control being operationally coupled to said motor assembly, said remote control being adapted for being engaged by the fisherman such that said remoter control is for controlling said motor assembly.

19. A propelling system for propelling a fisherman flotation device, the propelling system:

a frame assembly having a plurality of strap members, each of said strap members being adapted for selectively engaging the floatation device such that said strap members are for securing said frame assembly to the floatation device;

a propelling assembly being coupled to said frame assembly, said propelling assembly adapted for propelling the flotation device along the top of the water when a fisherman is positioned in the floatation device;

at least one rod member being coupled to said frame member, said rod member being adapted for holding a fishing rod, said rod member being adapted for being positioned proximate the fisherman such that said rod member facilitates access to the fishing rod by the fisherman when the fisherman is positioned in the floatation device; and said frame assembly having a plurality of wheel members, each of said wheel members being pivotally coupled to said housing of said frame assembly such that each of said wheel members are selectively pivoted between a stored position and a deployed position, said deployed position being defined by each of said wheel members extending downwardly from said housing such that each of said wheel members is adapted for engaging the ground for facilitating transportation of said frame assembly and the flotation device across land, said stored position being defined by each of said wheel members being positioned adjacent a rear wall of said housing when the floatation device is positioned in the water.

20. The propelling system as set forth in claim 19, further comprising:

each of said wheel members having a support portion and a wheel, said support portion being coupled to said housing of said frame assembly, said wheel being rotatably coupled to a free end of said support portion such that said wheel is adapted for rolling across the ground when the associated one of said wheel members is in said deployed position.

* * * * *